US005584683A

United States Patent [19]

Sher

[11] Patent Number: 5,584,683

[45] Date of Patent: Dec. 17, 1996

[54] SAFETY LIGHTER WITH STRIKER WHEEL STOPPER

[75] Inventor: Tak C. Sher, North Point, Hong Kong

[73] Assignees: Polycity Industrial Limited; Tak Fi International (Holidins) Limited, both of Quarry Bay, Hong Kong

[21] Appl. No.: 611,069

[22] Filed: Mar. 5, 1996

[51] Int. Cl.[6] ..... F23D 11/36

[52] U.S. Cl. ..... 431/153; 431/277

[58] Field of Search ..... 431/277, 153

[56] References Cited

U.S. PATENT DOCUMENTS

| | | | |
|---|---|---|---|
| 1,746,949 | 2/1930 | Kollstede | 431/137 X |
| 1,762,079 | 6/1930 | Rubsamen | 431/136 |
| 2,262,806 | 11/1941 | Kempf et al. | 431/137 X |
| 2,449,414 | 9/1948 | Rogers | 431/139 |
| 2,795,945 | 6/1957 | Coenders | 431/136 X |
| 3,079,781 | 3/1963 | Virtanen | 431/137 X |
| 3,895,904 | 7/1975 | Kimball | 431/277 |
| 3,966,392 | 6/1976 | Lockwood | 431/277 |
| 4,717,335 | 1/1988 | Loveless | 431/277 |
| 5,066,220 | 11/1991 | Vick | 431/277 |
| 5,074,781 | 12/1991 | Fujita | 431/277 X |
| 5,085,578 | 2/1992 | Hunter | 431/277 |
| 5,090,893 | 2/1992 | Floriot | 431/153 |
| 5,092,764 | 3/1992 | McDonough et al. | 431/277 |
| 5,104,313 | 4/1992 | Zellweger | 431/277 |
| 5,125,829 | 6/1992 | McDonough et al. | 431/153 |
| 5,165,885 | 11/1992 | Iwahori | 431/153 |
| 5,184,948 | 2/1993 | Iwahori | 431/276 |
| 5,186,618 | 2/1993 | Shike | 431/276 |
| 5,197,870 | 5/1993 | Yang | 431/153 |
| 5,213,493 | 5/1993 | Iwahori | 431/153 |
| 5,213,495 | 5/1993 | Pan | 431/344 |
| 5,215,458 | 6/1993 | Cirami | 431/277 |
| 5,224,854 | 7/1993 | Ansquer | 431/277 |
| 5,271,731 | 6/1994 | Hsin-Chung | 431/254 |
| 5,324,193 | 6/1994 | Pan | 431/277 |
| 5,356,286 | 10/1994 | Sher | 153/277 |
| 5,460,516 | 10/1995 | Sher | 431/153 |
| 5,490,773 | 2/1996 | Lliveras Capilla | 431/153 |

FOREIGN PATENT DOCUMENTS

| | | | |
|---|---|---|---|
| 296281 | 12/1988 | European Pat. Off. | 431/153 |
| 495249 | 10/1919 | France | 431/273 |
| 745844 | 5/1933 | France | 431/273 |
| 819929 | 9/1951 | Germany | 431/136 |
| 1176909 | 8/1964 | Germany | 431/276 |

*Primary Examiner*—Carl D. Price
*Attorney, Agent, or Firm*—Ladas & Parry

[57] ABSTRACT

The lighter of the present invention comprises an igniter having a flint and striker wheel which rotates about an axis in response to force applied to the wheel by a user's thumb (or any other finger or hand part). The striker wheel of the present invention differs from the striker wheels of the prior art in that stoppers extend out from at least one side of the striker wheel. The mounting frame in which the striker wheel is disposed is configured such that at least one of the stoppers engages with the mounting frame when the striker wheel is rotated, thereby limiting the distance that the striker wheel can be rotated, unless the striker wheel is depressed relative to the mounting frame when rotation is attempted. When the striker wheel is depressed, the stoppers avoid engagement with the mounting frame and the striker wheel may be rotated a sufficient distance at a sufficient speed to create sparks against the flint. The amount of force required to depress the striker wheel relative to the mounting frame is within the range of forces capable of being administered by an adult, but beyond the range of forces capable of being administered by a child.

3 Claims, 6 Drawing Sheets

SAFETY LIGHTER WITH STRIKER WHEEL STOPPER

FIELD OF THE INVENTION

This invention relates to the field of lighters, such as cigarette lighters.

BACKGROUND OF THE INVENTION

Modern butane lighters have become very popular. One of the reasons for their popularity is that the height of the flame produced by the lighter can be varied over a wide range by varying the amount of fuel allowed to be ejected from the lighter. The very feature that makes such lighters attractive to the users also makes such lighters dangerous if they are accidentally ignited. When the lighter produces a flame in an uncontrolled circumstance, particularly when the lighter is set on its high setting, materials (such as curtains, clothing, hair) may accidentally be lit on fire. Modern butane lighters are particularly dangerous when they are in the hands of children.

The invention disclosed herein substantially reduces the risk that a lighter will be ignited by a child.

SUMMARY OF THE INVENTION

Conventional butane lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and an igniter such as a striker wheel, flint and spring combination, which igniter is positioned close to the rear end of the lever so that the igniter and the rear end of the lever may be actuated nearly simultaneously. The striker wheel has a series of protuberances extending outward from its circumference. The protuberances serve two purposes. One is to provide a surface which will strike against the flint with instantaneously high friction, the other is to provide a gripping surface against which the user's thumb will rest and frictionally engage such that movement of the thumb will cause the striker wheel to rotate. When the user's thumb causes the striker wheel to rotate, the protuberances extending out from the wheel's circumference create sparks upon striking the flint, and a flame is caused to be ignited from the head of the nozzle from which fuel is being ejected while the rear end of the lever is being held down. Note that the purposes of the protuberances will be served if the striker wheel's circumference has grooves formed in it instead of having protuberances extending outward from it.

Lighters which pre-date butane lighters are similar to the above-identified conventional butane lighters except that instead of having a nozzle in connected relationship with the reservoir, a wick or similar device is used, and there is no need for a nozzle actuating lever.

The safety device of the present invention works effectively with either form of lighter.

In a preferred embodiment of the invention, the lighter comprises an igniter having a striker wheel which rotates about an axis in response to force applied to the wheel by a user's thumb (or any other finger or hand part). The striker wheel of the present invention differs from the striker wheels of the prior art in that stoppers extend out from at least one side of the striker wheel. The mounting frame in which the striker wheel is disposed is configured such that at least one of the stoppers engages with the mounting frame when the striker wheel is rotated, thereby limiting the distance that the striker wheel can be rotated, unless the striker wheel is depressed relative to the mounting frame when rotation is attempted. When the striker wheel is depressed, the stoppers avoid engagement with the mounting frame and the striker wheel may be rotated a sufficient distance at a sufficient speed to create sparks against the flint. The amount of force required to depress the striker wheel relative to the mounting frame is within the range of forces capable of being administered by an adult, but beyond the range of forces capable of being administered by a child.

DETAILED DESCRIPTION OF THE INVENTION

Figure 1:
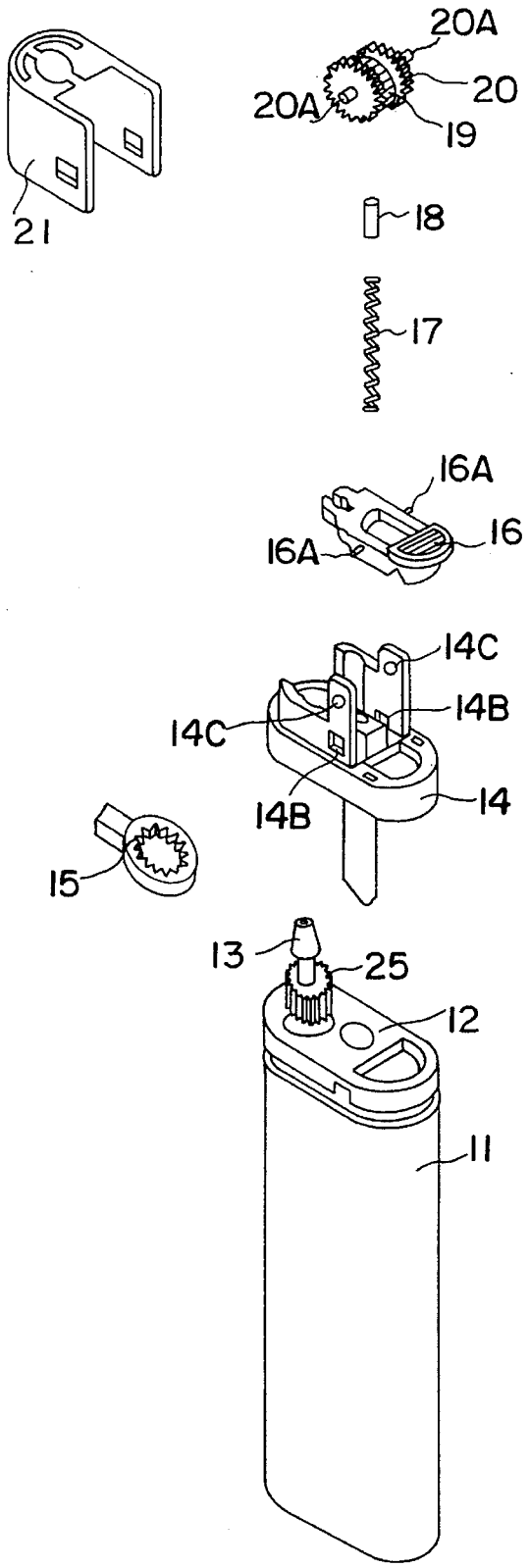
FIG. 1 PRIOR ART
FIG. 1 is an exploded view of a prior art lighter.
Figure 2:
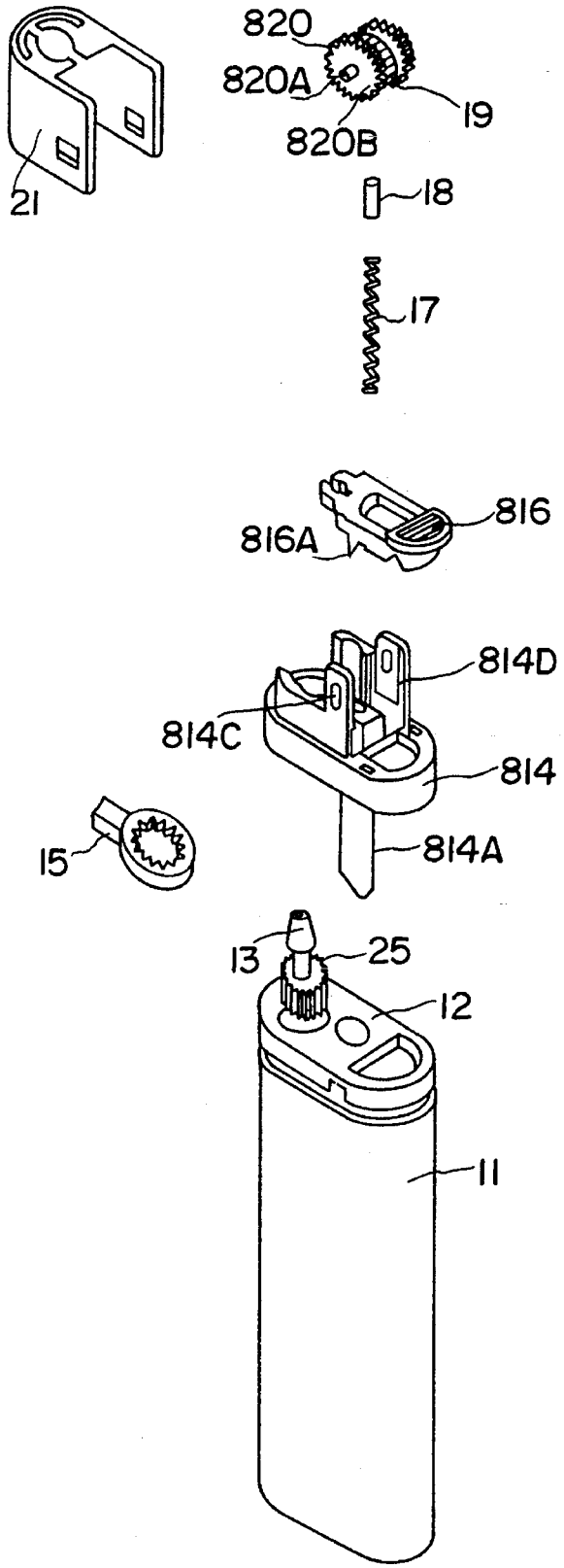
FIG. 2 is an exploded view the safety lighter of the present invention.
Figure 3:
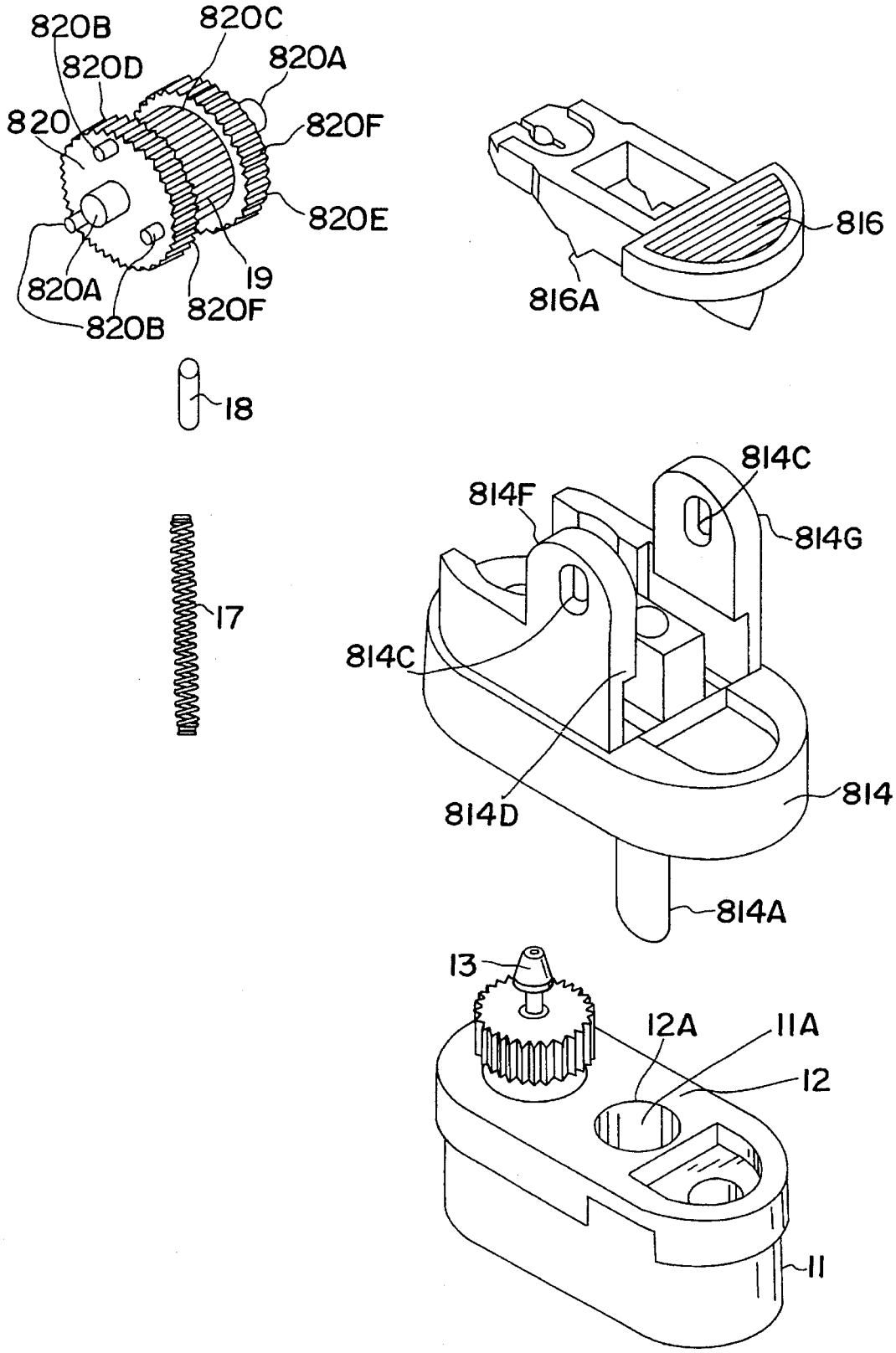
FIG. 3 is a detailed exploded view of that portion of the lighter shown in FIG. 2 which more clearly shows the inventive aspects of the present invention.

The preferred embodiment of the invention is illustrated in the attached drawings which are referred to herein. The same reference numeral will be used to identify identical elements throughout the drawings.

FIG. 1 illustrates components of a prior art lighter commonly mounted on a lighter body 11 in which lighter fuel is contained. Such components include platform 12 disposed upon the top of the lighter body, nozzle 13 having a head and a downwardly extending tube disposed toward the front of the lighter body, flame adjustment wheel 25 and thumb adjustment actuator 15 which is connected to the flame adjustment wheel, mounting frame 14 which is disposed on top of platform 12, windshield 21, nozzle actuating lever 16, and an igniter comprising compression spring 17, flint 18 and striker wheel 20.

The tube of the nozzle is connected in communicating relationship with the interior of the lighter body where, as mentioned above, fuel is stored. The nozzle may be moved from a lower position to an upper position. When the nozzle is in its lower position, fuel cannot be ejected from it. When the nozzle is in the upper position, fuel is ejected from it.

In normal operation, a lighter's striker wheel is rotated about its axis 20A, the ends of which are disposed in holes 14C formed in the upper part of the mounting frame, and the rear of lever 16 is depressed virtually simultaneously, which causes the lever to pivot on its pivot points 16A which are disposed in openings 14B formed in the mounting frame. As a result, the front of the lever moves up, which causes the nozzle to be raised. A spark is created when the teeth 19 of the rotating striker wheel fictionally engage the flint 18. The spark ignites the fuel and a flame is maintained so long as the rear of the lever is continued to be depressed downward.

The preferred embodiment of the safety lighter of the present the invention is illustrated in FIGS. 2–9. The preferred embodiment of the safety lighter of the present the invention is the same as the prior art lighter of FIG. 1 except in the configuration of the striker wheel and the mounting frame. (It should be noted that in the preferred embodiment of the safety lighter of the present the invention the nozzle actuating lever 816 has its pivot point 816A disposed along the bottom of the lever. This pivot point rests on platform 12. The prior art lever 16 could be used with the lighter of the present invention as long as openings similar to openings 14B are formed in the mounting frame of the present invention.)

Mounting frame 814 is mounted on platform 12 with the mounting frame's hollow stem inserted through hole 12A in the platform into cavity 11A formed in the lighter body 11.

The striker wheel 820 is mounted on frame 814 with the two ends of the wheel's axis 820A fitting into elongated slots 814C of the first and second tower portions 814F and 814G of the mounting frame.

Flint 18 and flint spring 17 are mounted in hollow 814E of the mounting frame's stem and cavity 11A in the conventional fashion so as to urge the flint 18 toward teeth 19 which are disposed on the recessed circumference 820C of the striker wheel. The lateral portions 820D and 820E of the striker wheel have knurled surfaces 820F on their circumferences which provide thumb grips.

Figure 6:
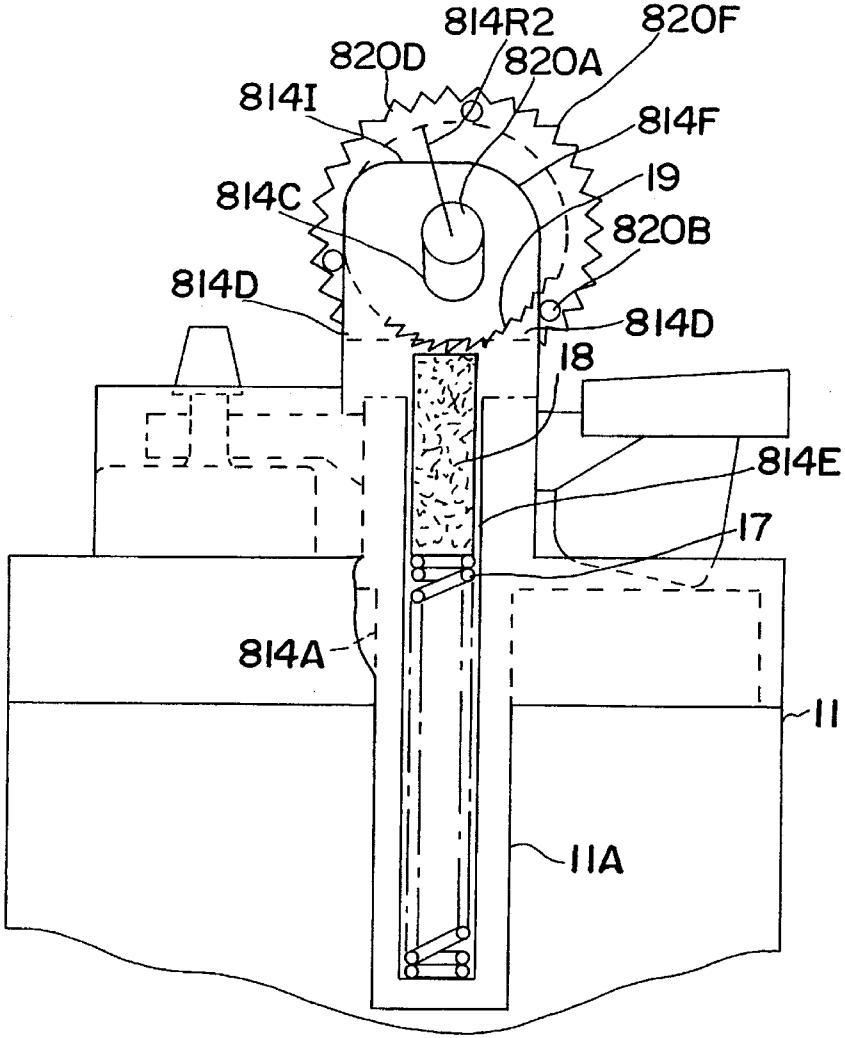
FIG. 6 is a partial side elevational view of the lighter of the present invention, partially broken away and sectioned, showing the striker wheel in the safety position.

Teeth 19 are a saw-tooth-shaped, each of the teeth having a first surface which is substantially perpendicular to the tangent to the circle from which the teeth extend. This first surface faces in the clockwise direction as the lighter is viewed from the side shown in FIGS. 6 and 8. Each of the teeth also has a second surface which slopes toward the counter-clockwise direction of the wheel when the lighter is viewed from its side with the front (or nozzle) end of the lighter toward the left as shown in FIGS. 6 and 8.

The purpose of teeth 19 is to provide a surface which will strike against the flint with instantaneously high friction. The purpose of knurled surfaces 820F is to provide a gripping surface against which the user's thumb will rest and frictionally engage such that movement of the thumb will cause the striker wheel to rotate. When the user's thumb causes the striker wheel to rotate in the clockwise direction, the teeth 19 extending out from the wheel's recessed circumference create sparks upon striking the flint, and a flame is caused to be ignited from the head of the nozzle from which fuel is being ejected while the rear end of the lever is being held down.

The striker wheel 820 of the present invention has stoppers 820B extending outward from the striker wheel's lateral portion 820D. These stoppers extend outward in a direction which is substantially parallel to the axis of the striker wheel, and are spaced equidistantly from said axis.

Figure 5:
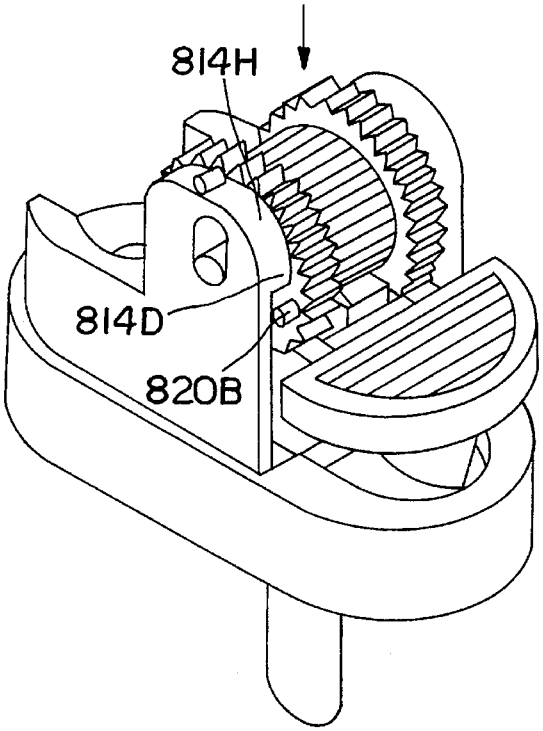
FIG. 5 is a perspective view of a portion of the safety lighter of the present invention showing the striker wheel in the operational position.
Figure 9:
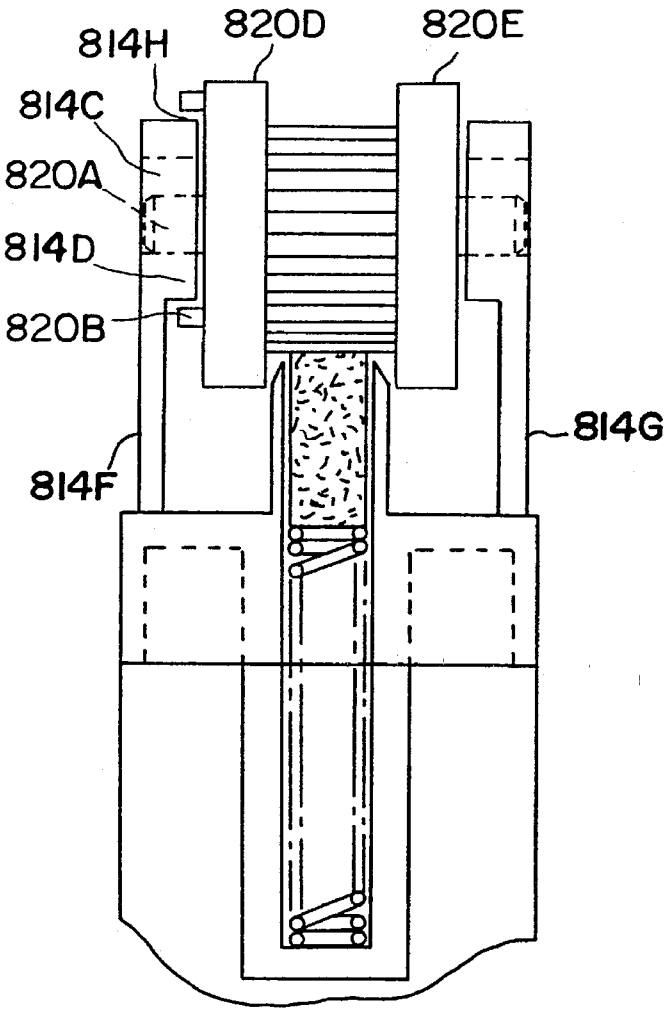
FIG. 9 is a partial rear elevational view of the lighter of the present invention, partially broken away and sectioned, showing the striker wheel in the operational position.
Figure 8:
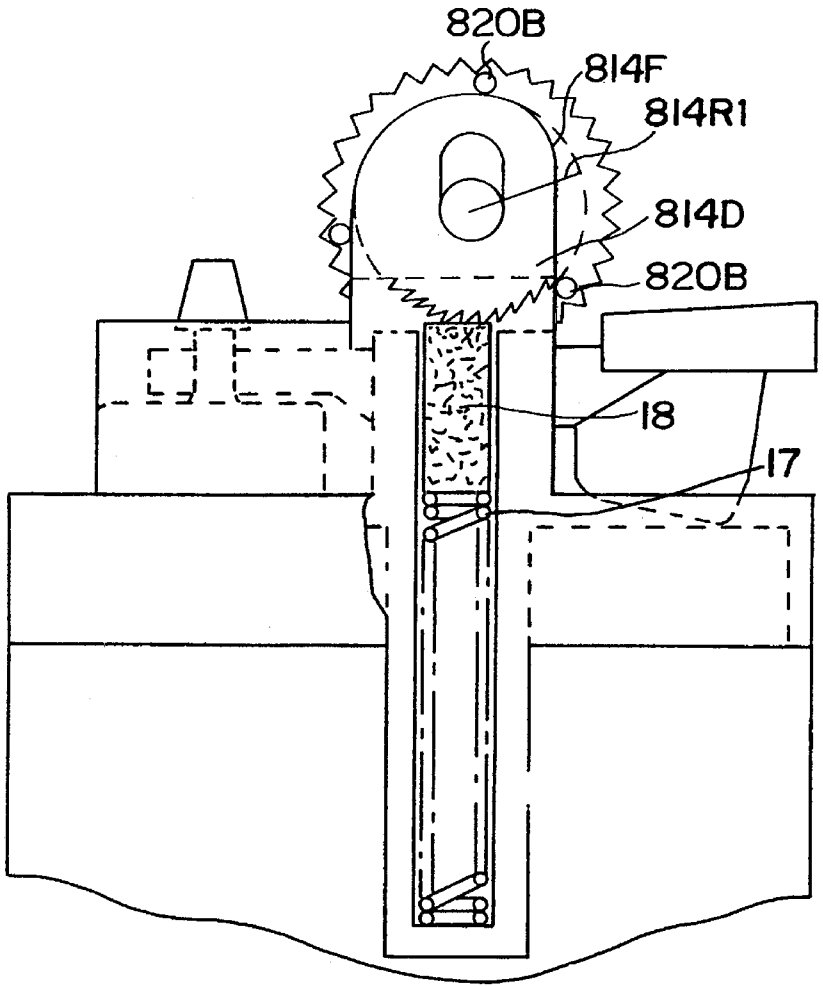
FIG. 8 is a partial side elevational view of the lighter of the present invention, partially broken away and sectioned, showing the striker wheel in the operational position.

The upper portion of outer rim 814I of first tower 814F (i.e., the tower disposed adjacent to the lateral portion of the striker from which the stoppers extend) is shaped so that it would fit within a first imaginary arc having a radius 814R1 which is equal to the distance between the axis of the striker wheel and a stopper, with the center of said arc originating from the point where the center of the striker wheel's axis is located when the striker wheel is in the lower, or operational, position as illustrated in FIGS. 5, 8 and 9.

Figure 4:
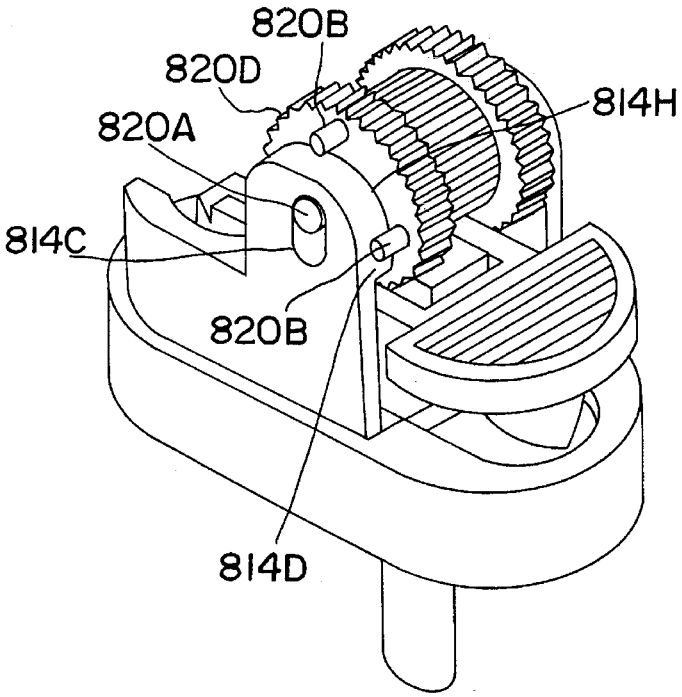
FIG. 4 is a perspective view of a portion of the safety lighter of the present invention showing the striker wheel in the safety position.
Figure 7:
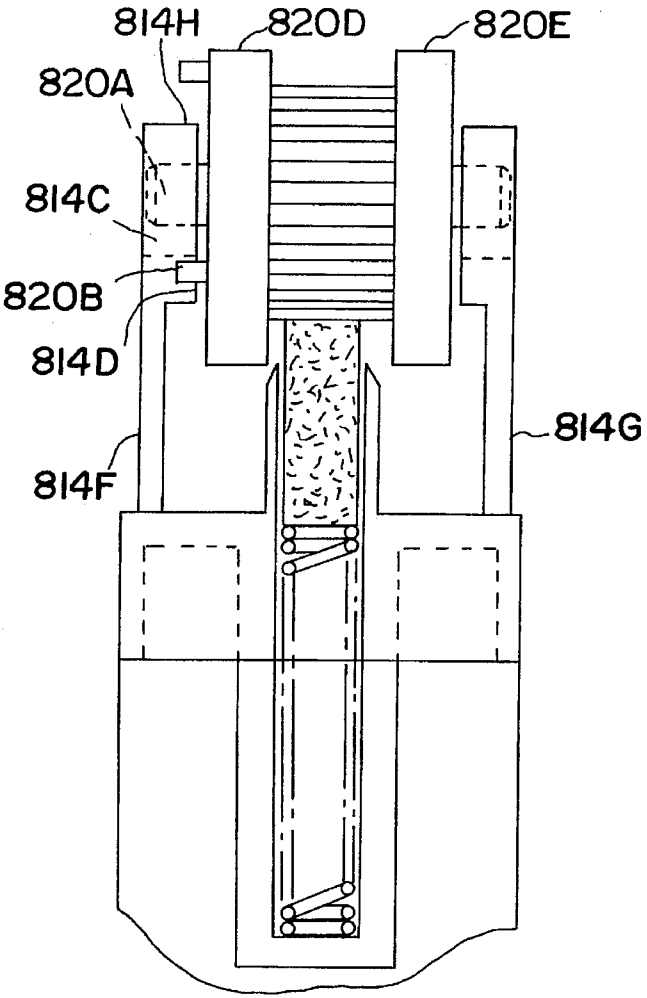
FIG. 7 is a partial rear elevational view of the lighter of the present invention, partially broken away and sectioned, showing the striker wheel in the safety position.

The upper surface of tower 814F has a flange 814H extending inward (i.e., toward the striker wheel). The flange's lower extremities 814D extend down along the rim on both sides of the first tower below the points where a second imaginary arc, having its center originating from the point where the center of the striker wheel's axis is located when the striker wheel is in the upper, or safety, position as illustrated in FIGS. 4, 6 and 7, and a radius 814R2 equal to the distance between the axis of the striker wheel and a stopper, would intersect the tower. However the flange's lower extremities 814D terminate above the points where the first imaginary arc (i.e., the arc having radius 814R1 which is equal to the distance between the axis of the striker wheel and a stopper, with the center of said arc originating from the point where the center of the striker wheel's axis is located when the striker wheel is in the lower, or operational, position) intersects the rim of the first tower, as illustrated in FIGS. 5, 8 and 9.

Each of the stoppers is sufficiently long that it extends over the flange when the striker wheel is in the safety position (see FIG. 7), but not so long that it extends over that portion of the tower which does not have the flange (see FIG. 9). It should be noted that the invention would work with one or more stoppers extending out from a lateral portion of the striker wheel. In the preferred embodiment, three stoppers, each equidistant from the others, extend out from lateral portion 820D.

In the lighter of the present invention, when the striker wheel is in the upper, or safety, position, and an attempt is made to rotate the striker wheel in the clockwise direction, the stopper closest to the rear of the lighter comes into abutting relationship with the lower portion of flange 814H on the side of the tower which faces toward the rear of the lighter. As a result, the striker wheel cannot be rotated in the clockwise direction at a sufficient speed or distance to create a spark as teeth 19 contact flint 18. See FIGS. 4, 6 and 7. Similarly, when the striker wheel is in the upper, or safety, position, and an attempt is made to rotate the striker wheel in the counterclockwise direction, the stopper closest to the front of the lighter comes into abutting relationship with the lower portion of flange 814H on the side of the tower which faces toward the front of the lighter. As a result, the striker wheel cannot be rotated in the counterclockwise direction at a sufficient speed or distance to create a spark as teeth 19 contact flint 18. (Counterclockwise rotation of the striker wheel will not create a spark for the further reason that the teeth are shaped so that when the striker wheel is rotated in the counterclockwise location, the frictional force created as the teeth strike the flint is insufficient to create a spark.)

The striker wheel is maintained in the safety position (i.e., toward the upper edge of each of slots 814C as shown in FIGS. 4, 6 and 7) by the upwardly directed force exerted by spring 17 through flint 18. In order to move the striker wheel to the lower, or operational, position (i.e., toward the lower edge of each of slots 814C as shown in FIGS. 5, 8 and 9), the user of the lighter must press down on the striker wheel with a force, or pressure, which is greater than the upward force exerted by spring 17. When the user does this, the striker wheel will be caused to move downward. When axis 820A of the striker wheel reaches the lower edge of slots 814C in towers 814F and 814G of the mounting frame 814, the striker wheel is in the operational position.

When the striker wheel is in the lower, or operational, position, and an attempt is made to rotate the striker wheel in the clockwise direction, the stopper closest to the rear of the lighter passes below the lower portion of flange 814H on the side of the tower which faces toward the rear of the lighter. See FIGS. 5, 8 and 9. Similarly, the stopper closest to the front of the lighter passes below the lower portion of flange 814H on the side of the tower which faces toward the front of the lighter. As a result, the striker wheel can be rotated in the clockwise direction at a sufficient speed and distance to create a spark as teeth 19 contact flint 18.

The amount of force required to depress the striker wheel relative to the mounting frame is within the range of forces capable of being administered by an adult, but beyond the range of forces capable of being administered by a child. Therefore, the lighter of the present invention is much less likely than a conventional lighter to create dangerous situations in the event that the lighter gets in the hands of a child.

Above there has been described a unique safety lighter. It should be understood that various changes of the details, materials, arrangements of parts and uses which have been herein described and illustrated in order to explain the nature of the invention will occur to and may be made by those schooled in the art upon the reading of this disclosure, and such changes are intended to be included within the principles and scope of this invention.

I claim:

1. A lighter comprising a lighter body, a mounting frame disposed on top of said lighter body, a striker wheel inserted in said mounting frame, a flint and a spring;

said striker wheel comprising an axis having first and second ends about which said striker wheel rotates and at least one stopper extending out from said striker wheel in a direction substantially parallel to said axis, said at least one stopper being disposed a distance from said axis;

said mounting frame comprising first and second tower portions extending upward from said lighter body, said first tower portion having a first elongated slot formed therein and said second tower portion having a second elongated slot formed therein, wherein each of said first and second slots has an upper edge and a lower edge, wherein said first and second slots have substantially equal lengths and are disposed substantially equal distances above the lighter body, wherein said striker wheel is disposed between said first and second tower portions with said at least one stopper extending toward said first tower and with said first end of said axis disposed in said first slot and said second end of said axis disposed in said second slot, and wherein said striker wheel reciprocates between an upper position in which said first and second ends of said axis are adjacent said upper edges of said first and second slots, respectively, and a lower position in which said first and second ends of said axis are adjacent said lower edges of said first and second slots, respectively;

said first tower having an outer rim having an upper portion which is shaped such that said upper portion would fit within a first imaginary arc having a first radius which is equal to the distance between said axis of the striker wheel and said stopper, with said first imaginary arc's radial center originating from where said axis is located when the striker wheel is in the lower position, said first tower also having a flange extending from said rim in toward said striker wheel, said flange having lower extremity reaching down along the rim of said first tower below where a second imaginary arc intersects said rim, said second imaginary arc having a second radius which is equal to the distance between said axis of the striker wheel and said stopper, with said second imaginary arc's radial center originating from where said axis is located when the striker wheel is in the upper position, and with said flange's lower extremity terminating above where said first imaginary arc intersects said rim, wherein said at least one stopper extends out toward said first tower and wherein said stopper is sufficiently long to extend out over said flange and sufficiently short to avoid abutting into said rim where said rim is devoid of said flange;

said mounting frame and said lighter body having a cavity formed therein, said cavity being disposed below said striker wheel;

said flint and said spring being disposed in said cavity such that said spring exerts an upward force to urge said flint into adjacent and abutting relationship with said striker wheel and to urge said striker wheel into said upper position;

whereby rotation of said striker wheel is inhibited when said striker wheel is in said upper position and said striker wheel can only be placed in said lower position when downward pressure, sufficient to overcome said upward force, is applied to said striker wheel.

2. The lighter of claim 1, wherein said spring is a compression spring.

3. The lighter of claim 1, wherein said striker wheel comprises at least three stoppers, each equidistant from the others.

* * * * *

UNITED STATES PATENT AND TRADEMARK OFFICE

CERTIFICATE OF CORRECTION

PATENT NO. : 5,584,683

DATED : December 17, 1996

INVENTOR(S) : Tak Chi Sher

It is certified that error appears in the above-identified patent and that said Letters Patent is hereby corrected as shown below:

On the title page: Item [73]

second Assignee's name is incorrectly shown as:

Tak Fi International (Holidins) Limited...

The second Assignee's name should be corrected to:

Tak Fi International (Holdings) Limited...

Signed and Sealed this

Ninth Day of December, 1997

*Attest:*

*Attesting Officer*

BRUCE LEHMAN

*Commissioner of Patents and Trademarks*